US008827096B1

(12) United States Patent
Macpherson

(10) Patent No.: US 8,827,096 B1
(45) Date of Patent: Sep. 9, 2014

(54) COMBINATION PAINT CAN AND NON-SPLASH LID WHICH ELIMINATES THE SUMP AREA AT THE TOP OF THE PAINT CAN AND PROVIDES A MATING RECESS ON THE BOTTOM OF THE PAINT CAN TO FACILITATE STACKING ONE PAINT CAN ON TOP OF ANOTHER PAINT CAN

(76) Inventor: Donald E. Macpherson, Thousand Oaks, CA (US)

( * ) Notice: Subject to any disclaimer, the term of this patent is extended or adjusted under 35 U.S.C. 154(b) by 0 days.

(21) Appl. No.: 13/605,078

(22) Filed: Sep. 6, 2012

Related U.S. Application Data

(60) Provisional application No. 61/573,642, filed on Sep. 9, 2011.

(51) Int. Cl.
*B65D 6/28* (2006.01)

(52) U.S. Cl.
USPC ..... 220/4.27; 220/634; 220/641; 206/503; 206/509

(58) Field of Classification Search
USPC ..... 220/380, 634, 641, 781, 788, 789, 783, 220/4.26, 4.27; 206/503, 509
See application file for complete search history.

(56) References Cited

U.S. PATENT DOCUMENTS

| | | | | | |
|---|---|---|---|---|---|
| 606,838 | A | * | 7/1898 | Heins | 220/797 |
| 834,191 | A | * | 10/1906 | Chambers | 220/789 |
| 1,109,649 | A | * | 9/1914 | Lang, Jr. | 220/380 |
| 2,403,030 | A | * | 7/1946 | Solinsky | 220/784 |
| 2,418,502 | A | * | 4/1947 | Ferguson | 220/797 |
| 2,521,098 | A | * | 9/1950 | Sebell | 220/276 |
| 2,672,256 | A | * | 3/1954 | Sebell | 220/699 |
| 2,885,108 | A | * | 5/1959 | Donoghue | 220/798 |
| 2,897,994 | A | * | 8/1959 | Foss | 220/4.27 |
| 2,899,096 | A | * | 8/1959 | Henchert et al. | 220/4.27 |
| 3,329,302 | A | * | 7/1967 | Kitchen | 220/284 |
| 3,799,388 | A | * | 3/1974 | Knize | 220/240 |
| 3,834,579 | A | * | 9/1974 | LaCroce | 220/319 |
| 4,051,951 | A | * | 10/1977 | Smith | 206/508 |
| 4,154,360 | A | * | 5/1979 | Smith | 220/258.3 |
| 4,180,179 | A | * | 12/1979 | Hoenig et al. | 220/783 |
| 4,305,535 | A | * | 12/1981 | Brundige et al. | 229/5.7 |
| 4,312,459 | A | * | 1/1982 | Leach | 220/256.1 |
| 4,356,930 | A | * | 11/1982 | Roper | 220/783 |
| 4,397,404 | A | * | 8/1983 | Blanchette | 220/783 |
| 4,407,426 | A | * | 10/1983 | McLaren et al. | 220/781 |
| 4,421,247 | A | * | 12/1983 | Lombardo et al. | 220/798 |
| 4,667,843 | A | * | 5/1987 | Galer | 220/798 |
| 4,905,861 | A | * | 3/1990 | Boxall et al. | 220/266 |

(Continued)

*Primary Examiner* — Fenn Mathew
*Assistant Examiner* — Christopher McKinley
(74) *Attorney, Agent, or Firm* — Thomas I. Rozsa

(57) ABSTRACT

A combination paint can and non-splash lid which eliminates the sump area at the top of the paint can by providing a vertically oriented arcuate interior rim surrounding the opening which leads to the storage container where the paint is stored. The combination also includes a matching lid which can tightly fit onto the vertically oriented rim so that the paint can is able to be tightly sealed but when the lid is removed and paint is dispensed, there is not an interior sump where the paint can land and create problems. The device also contains a matching bottom which is designed to be inter-fit with a top to enable one paint can to be stacked on top of the other paint can and locked in place so that when they are vertically stacked, the upper paint can will not fall away from or off the lower paint can.

1 Claim, 3 Drawing Sheets

(56) References Cited

U.S. PATENT DOCUMENTS

| | | | | | |
|---|---|---|---|---|---|
| 5,097,977 | A * | 3/1992 | Straub | 220/783 |
| 5,161,689 | A * | 11/1992 | Balson | 206/509 |
| 5,174,464 | A * | 12/1992 | Watt | 220/256.1 |
| 5,381,918 | A * | 1/1995 | Dahl | 220/784 |
| 5,669,523 | A * | 9/1997 | Mueller et al. | 220/4.27 |
| 5,842,593 | A * | 12/1998 | von Holdt | 220/212.5 |
| 5,899,352 | A * | 5/1999 | Guarda et al. | 220/254.1 |
| 5,915,557 | A * | 6/1999 | Levine | 206/509 |
| 5,967,363 | A * | 10/1999 | Allen | 220/806 |
| 6,253,951 | B1 * | 7/2001 | Pruckler | 220/733 |
| 6,588,618 | B1 * | 7/2003 | Davis | 220/254.7 |
| 6,964,348 | B2 * | 11/2005 | Breimon et al. | 220/783 |
| 7,311,218 | B2 * | 12/2007 | Varadarajan | 220/257.1 |
| 7,584,866 | B2 * | 9/2009 | Selina et al. | 220/698 |
| 2003/0141311 | A1 * | 7/2003 | Ceolin et al. | 220/701 |
| 2003/0168465 | A1 * | 9/2003 | Breimon et al. | 220/783 |
| 2006/0043095 | A1 * | 3/2006 | Maholm et al. | 220/701 |
| 2009/0236354 | A1 * | 9/2009 | Alvares et al. | 220/783 |
| 2010/0236966 | A1 * | 9/2010 | Luttik et al. | 206/508 |
| 2011/0036843 | A1 * | 2/2011 | Letica et al. | 220/319 |

* cited by examiner

COMBINATION PAINT CAN AND NON-SPLASH LID WHICH ELIMINATES THE SUMP AREA AT THE TOP OF THE PAINT CAN AND PROVIDES A MATING RECESS ON THE BOTTOM OF THE PAINT CAN TO FACILITATE STACKING ONE PAINT CAN ON TOP OF ANOTHER PAINT CAN

This patent application claims priority to Patent Application No. 61/573,642 filed on Sep. 9, 2011.

BACKGROUND OF THE INVENTION

1. Field of the Invention

The present invention relates to the field of paint cans and in particular, to the cover of the paint can which contains a sump area where paint can collect. The present invention also relates to the field of interlocking paint cans so that one paint can may be securely stacked on top of another paint can.

2. Description of the Prior Art

The following 15 prior art patents are relevant to the field of the present invention.

1. U.S. Pat. Des. 400,973 issued on Nov. 10, 1998 to Hall et al. for "DISC-SHAPED CONTAINER WHICH CAN HOLD SORBENT MATERIAL" (hereafter the "Hall patent").
2. U.S. Pat. Des. 472,145 issued on Mar. 25, 2003 to Nottingham et al. for "PAINT CONTAINER LID" (hereafter the "'145 Nottingham patent").
3. U.S. Pat. Des. 482,973 issued on Dec. 2, 2003 to Nottingham et al. for "SQUARE PAINT CONTAINER" (hereafter the "'973 Nottingham patent").
4. U.S. Pat. No. 2,659,519 issued on Nov. 17, 1953 to Allen for "POURING ATTACHMENT FOR PAINT AND THE LIKE" (hereafter the "Allen patent").
5. U.S. Pat. No. 2,873,881 issued on Feb. 17, 1959 to Nichols for "CONTAINER RIM PROTECTOR" (hereafter the "Nichols patent").
6. U.S. Pat. No. 2,898,006 issued on Aug. 4, 1959 to Taylo5 for 'PAINT CAN LID" (hereafter the "Taylor patent").
7. U.S. Pat. No. 3,428,213 issued on Feb. 18, 1969 to Stephens for "PAINT TYPE CAN AND ATTACHMENT" (hereafter the "Stephens patent").
8. U.S. Pat. No. 3,727,792 issued on Apr. 17, 1973 to Levin for "ATTACHMENT TO RIM OF A PAINT CAN OR THE LIKE" (hereafter the "Levin patent").
9. U.S. Pat. No. 4,312,459 issued to Leach on Jan. 26, 1982 for "PAINT CAN RIM COVER AND LID COMBINATION" (hereafter the "Leach patent").
10. U.S. Pat. No. 4,316,560 issued to Carter on Feb. 23, 1982 for "PAINT CAN DISPENSING RING ATTACHMENT" (hereafter the "Carter patent").
11. U.S. Pat. No. 4,955,500 issued to Rhoads on Sep. 11, 1990 for "SEALING GROOVE COVER" (hereafter the "Rhoads patent").
12. U.S. Pat. No. 5,921,448 issued to Stewart on Jul. 13, 1999 for "PAINT CONTAINER LID".
13. U.S. Pat. No. 4,969,570 issued to Harvey, Sr. on Nov. 13, 1990 for "PROTECTIVE RING FOR USE ON OPEN FRICTION LID CONTAINERS" (hereafter the "Harvey patent").
14. U.S. Pat. No. 5,975,346 issued on Nov. 2, 1999 to Imperato et al. fir "CONTAINER FOR PAINTS AND SIMILAR MATERIALS" (hereafter the "Imperato patent").
15. U.S. Pat. No. 5,161,689 issued on Nov. 10, 1992 to Balson for "RI SEAL FOR PAINT CAN LID" (hereafter the "Balson patent").

The above patents disclose covering and sealing devices and attachments that address the problem with paint accumulation in the sump area of conventional paint cans. The Figures in the Balson patent, such as FIGS. 11a, 11b and 11c illustrate the recessed lid of traditional paint cans.

None of the prior art patents disclose or suggest a new design of the paint can that actually eliminates the sump area.

SUMMARY OF THE INVENTION

The present invention is a combination lid structure and paint can top structure for paint cans that includes no sump area (described variously as an annular groove, sealing groove and annular channel in the paint can). In a conventional paint can, the sump area is a collection point for paint once the can is opened and paint is dispensed. The problem with the accumulation of paint in the sump area is that when the paint can lid is replaced, frequently by pounding it back in with a hammer, the annular rib in the lid causes paint in the sump area to squirt out, which can cause all kinds of cleanup and related problems. In addition, the design of conventional paint cans does not enable the top of one paint can to interlock with a bottom of another paint can so the paint cans are unstable when one is placed on top of another.

The innovations of the present invention comprise two very innovative features:

1. First the problems with the sump area on the top of the paint can are completely eliminated by a redesign of the top of the can and the lid which includes the following innovative components:

(a) one mating portion of the top of the can includes an attachment member which is permanently affixed to the top of the upper rim of the paint can (the top of the upper rim rests above the body of the paint can) and has a horizontal section which extends radially inward in a horizontal plane, then terminating in an interior circumferential upwardly extending generally "U"-shaped or arcuate rim which extends in a first vertical section perpendicular to and vertically away from the horizontal rim, curves in an upper rounded arcuate section and then extends downwardly in a second vertical section parallel to and spaced apart from the first vertical section to form an inverted or upside down "U" shaped opening, and then folds back on itself at the lower edge of the second section so as to avoid any sharp areas on the rim, the interior arcuate rim surrounding an interior opening which leads to the chamber in the can (surrounded by the paint can body and bottom) where paint is stored; and (b) the top also including a mating closing lid having an upwardly extending generally "U' shaped arcuate lid which extends in a first vertical section which folds in on itself at its bottom end, curves in an upward rounded arcuate section and then extends downwardly in the second vertical section parallel to and spaced apart from the first vertical section to form an inverted or upside down 'U" shaped opening which matches the interior arcuate "U" shaped section opening attached to the top of the paint can The upside down "U" shaped section of the top lid encircles an interior flat horizontally aligned top to close the opening in the center of the paint can. The inverted "U" shaped sections of bottom attached to the paint can and the top lid sections serve to tightly seal the lid and the upwardly extending inverted "U" shaped section attached to the top of the paint can eliminates the sump problem of paint accumulation as found in prior art cans.

2. The bottom of the paint can has an attachment section affixed to the bottom circumferential rim of the paint can and extends vertically upward on the inside circumferential interior of the bottom of the paint can and then extends in a horizontal section which matches the horizontal rim attached to the top of the paint can, then the bottom extends at a vertical angle to a rounded top which surrounds an interior horizontal lower bottom elevated above the bottom of the paint can so that the elevated horizontal bottom matches the top lid inverted "U" section and the horizontal upper section of the top lid matches the horizontal lower lid section of the bottom so that the upper lid interlocks with the bottom section so that one paint can is securely attached on top of another paint can.

It is an object of the present invention to create a unique upper lid with an upwardly extending inverted "U" shaped section to a paint can which eliminates the downwardly extending sump area on the top of the paint and includes a redesign of the top of the can and a mating top lid which mates with the upwardly extending inverted "U" shaped section on the redesigned bottom to create a mating tight fitting section of the lid to close the paint can.

It is also an object of the present invention to provide a unique bottom to the paint can which matches and is the inverse of the unique top of the paint can so that one paint can is able to be securely placed and interlocked with another paint can and vertically stacked in a secure manner so that the paint cans won't fall over.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
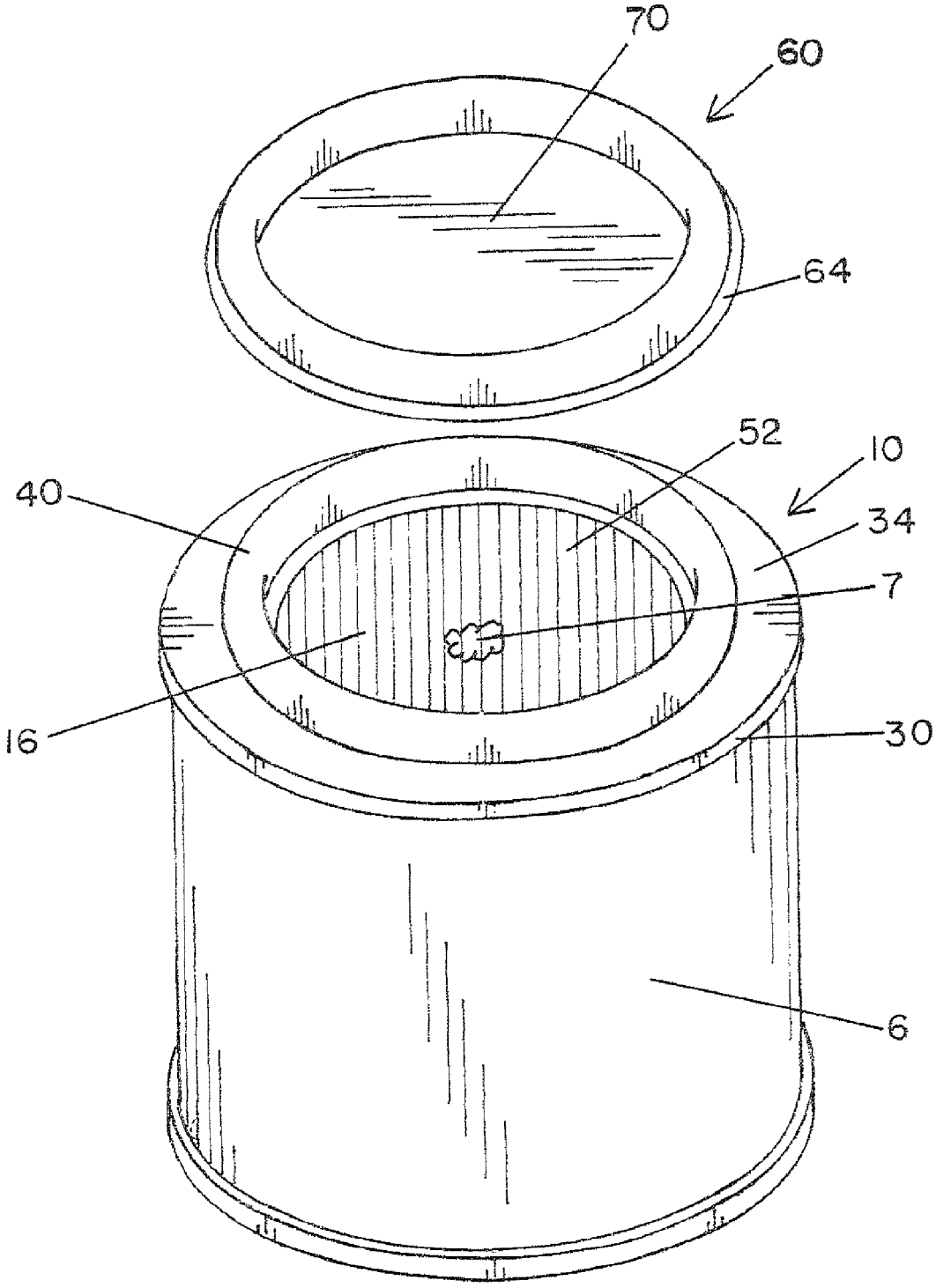
FIG. 1 is an exploded view of a portion of the present invention permanently affixed to the top rim of a paint can illustrating the radially inwardly extending horizontal section and a vertically extending inverted "U"-shaped interior circumferential section surrounding an opening to the paint can, and a mating top lid having a downwardly extending inverted "U"-shaped section that mates with the upwardly extending inverted "U" shaped section of the can and including a horizontal top to close the opening in the paint can.
Figure 2:
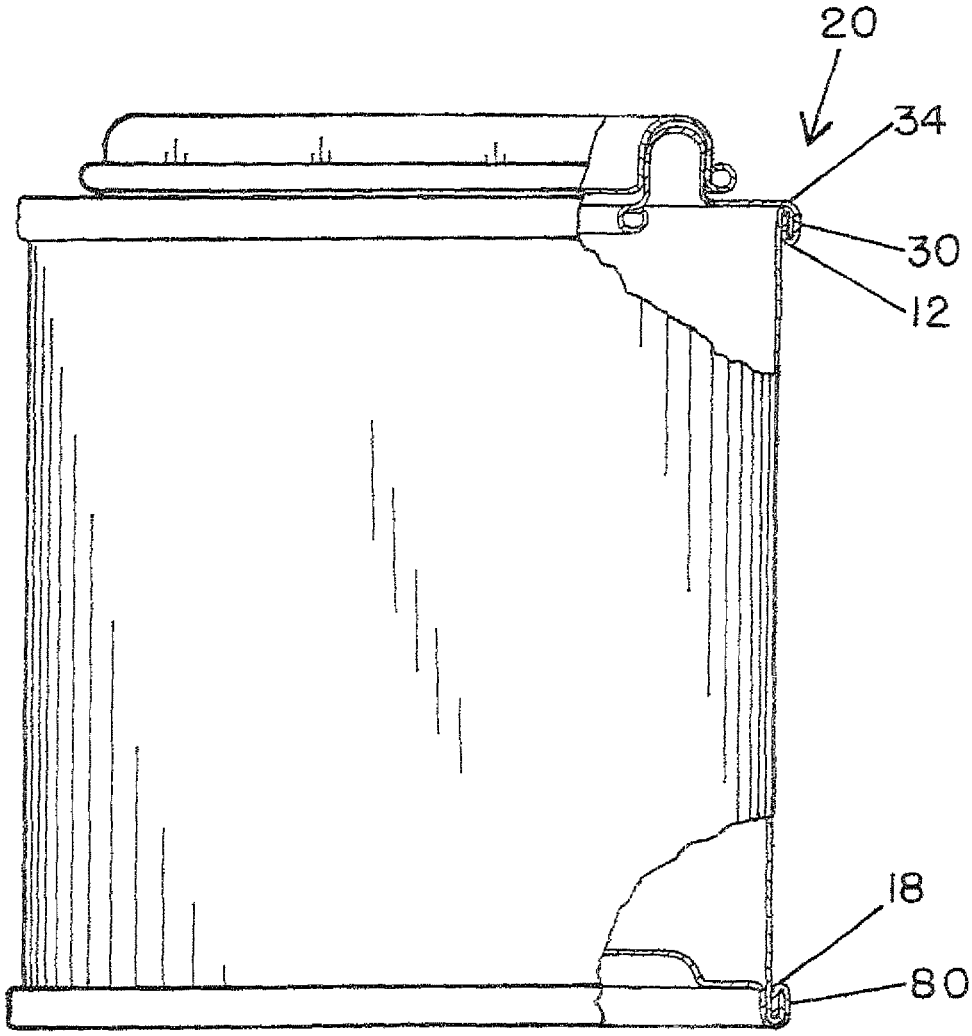
FIG. 2 is a side elevational view of a paint can with the top partially broken away to illustrate the innovative features of the present invention modification to the top of the paint can and the bottom of the paint can partially broken away to illustrate the present invention modification to the bottom of the paint can.
Figure 3:
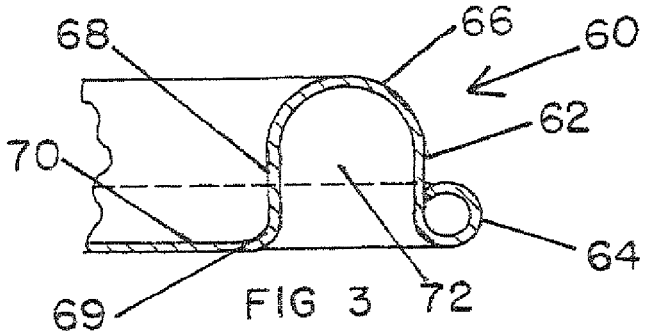
FIG. 3 is a partial cross-sectional view of the closing section of the top lid portion of the present invention lid.
Figure 4:
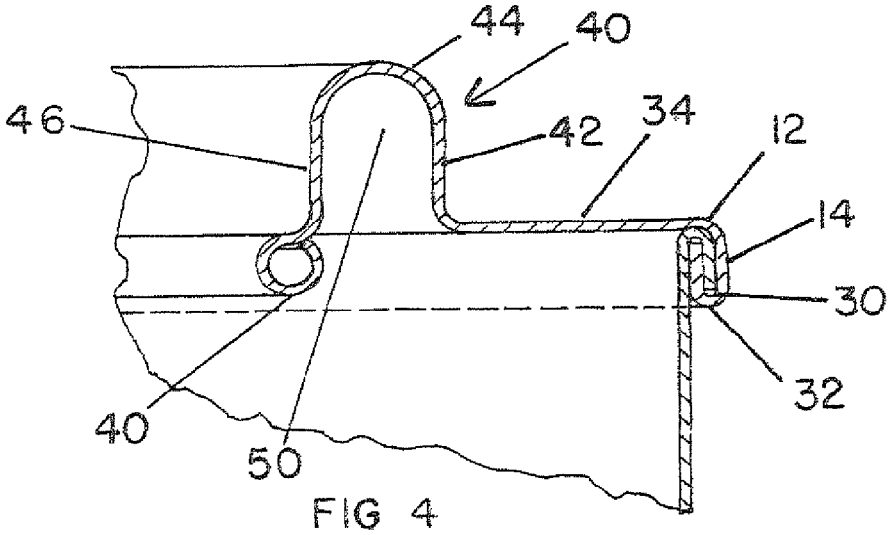
FIG. 4 is a partial cross-sectional view of the modification to the top of the paint can portion of the present invention lid.

FIG. 1 is an exploded view of the two parts of redesigned top portion of the present invention. For the first part, the top portion of a paint can is permanently affixed to the top rim of a paint can illustrating the radially inwardly extending horizontal section and a vertically extending inverted "U"-shaped interior circumferential section surrounding an opening to the paint can, and the second part is a mating top lid having a circumferential rim extending to a downwardly extending inverted "U"-shaped section that mates with the upwardly extending inverted "U"-shaped section of the paint can top and including a horizontal top to close the opening in the paint can. FIG. 2 is a side elevational view of a paint can with the top partially broken away to illustrate the innovative features of the present invention modification to the top of the pant can and the bottom of the paint can partially broken way to illustrate the present invention modification to the bottom of the paint can. FIG. 3 is a partial cross-sectional view of the top closing lid section of the top of the present invention lid. FIG. 4 is a partial cross-sectional view of the bottom section of the modification to the top of a paint can.

Referring to FIGS. 1 through 4, part of the innovation of the present invention addresses the problems with the sump area on the top 12 of the paint can 10 which are completely eliminated by a redesign of the lid 60 which includes the following innovative components: The body 6 of the paint can 10 extends to the top rim 12. One mating portion of the new lid 60 includes an attachment member 30 (see FIG. 4) which is permanently affixed to the top of the upper rim 12 of the paint can 10 by an arcuate section 32 crimped to the bent section 14 of the top rim 12 of the paint can 10. The top lid 60 extends from the attachment section 30 to a horizontal section 34 which extends radially inward in a horizontal plane, then terminating in an interior circumferential upwardly extending generally inverted "U"-shaped or arcuate rim 40 which has a first vertical wall 42 which extends perpendicular to and vertically away from the horizontal section 34, curves in an upper rounded arcuate section 44 and then extends downwardly with a second vertical wall 46 extending in the vertical direction parallel to and spaced apart from the first vertical wall 42 section and then folds back on itself at its lower edge 48 so as to avoid any sharp areas on the rim, the interior arcuate shaped rim 40 and its sections 42, 44, and 46 surrounding an interior opening mating channel 50, the interior arcuate shaped rim 40 also surrounding an interior opening 52 which leads to an interior paint can chamber 16 where paint 7 is stored.

The second portion of the present invention includes the top mating closing lid 60 having an inverted "U" shaped mating section which includes a first vertical wall 62 with its bottom 64 folding in on itself to avoid sharp edges, the first vertical wall 62 extends to an upper rounded arcuate section 66 which extends to a downwardly extending second vertical wall 68 which is formed in the same shape as the interior arcuate bottom section of the lid, the top closing lid 60 having a circumferential arcuate section 69 which encircles an interior flat horizontally aligned top 70 to close the opening 52 in center of the paint can. The mating closing lid 60 and its sections 62, 66 and 68 surround an interior opening mating channel 72. The arcuate bottom section 40 and its sections 42, 44 and 46 and the top arcuate section 60 and its sections 62, 66 and 68 serve to tightly seal the lid with channel 50 inserted into channel 72 and the upwardly extending bottom section 40 eliminates the sump problem of paint accumulation as found in prior art can.

Figure 6:
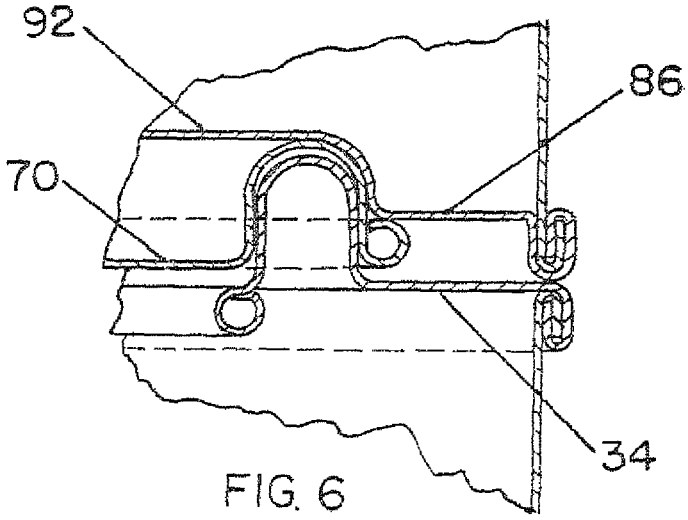
FIG. 6 is a partial cross-sectional view illustrating the top of one can interlocked with the bottom of a second can placed on top of the first can, illustrating how the present invention modifications and improvement to the top and bottom of the paint can enable the two paint cans to be interlocked so that the upper can will not fall off the lower can.
Figure 5:
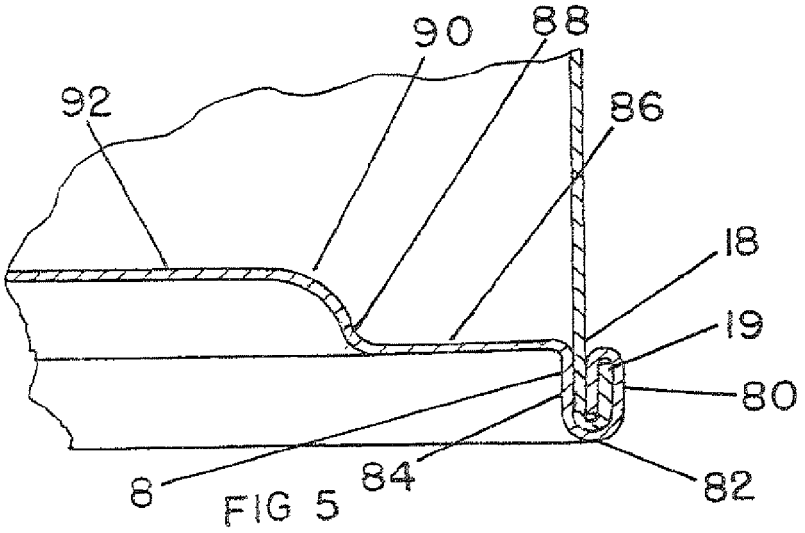
FIG. 5 is a partial cross-sectional view of the innovative bottom of the present invention modification to the bottom of the paint can.

FIG. 5 is a partial cross-sectional view of the innovative bottom of the present invention modification to the bottom of the paint can. FIG. 6 is a partial cross-sectional view illustrating the top of one can interlocked with the bottom of a second can placed on top of the first can, illustrating how the present invention modifications and improvement to the top and bottom of the paint can enable the two paint cans to be interlocked so that the upper can will not fall off the lower can.

Referring to FIG. 2 and FIG. 5, the bottom of the present invention has an attachment section 80 which is permanently affixed to the bottom circumferential rim 18 of the paint can 10 by an arcuate section 82 crimped to the bent section 19 of the bottom circumferential rim 18. The bottom circumferential rim 18 extends vertically upward with an inside wall 84 on the inside circumferential interior 8 of the bottom rim 18 of the paint can 10 and then extends to a horizontal section 86 which extends radially inward and terminates in a vertical angle section 88 which ends in a rounded top 90 which extends to a central horizontal bottom section 92, the first horizontal section 86 is elevated above the bottom of the paint can so that the elevated horizontal bottom 86 matches the top the horizontal upper section 34 of the top lid 60 and the second horizontal section 92 matches the top inverted "U" section and the top lid 60 and the horizontal section 70 of top closing lid so that, as illustrated in FIG. 6, the upper top lid 60 interlocks with the bottom section upper flat portion 92 so that one paint can is securely attached on top of another paint can.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A paint can having an upper circumferential rim with a top and a bent section, comprising:

a. a modification to the top of a paint can including an attachment member which is permanently affixed to the top of the upper rim of the paint can by an arcuate section crimped to the bent section of the upper rim of the paint can, the attachment section extending to a horizontal section where the horizontal section extends radially inward in a horizontal plane above the top of the upper rim of the paint can so that the horizontal section is never at a location below the top of the upper rim of the paint can, the horizontal section terminating in an interior circumferential upwardly extending generally inverted "U" shaped section which has a first vertical wall section with an exterior surface which extends perpendicular to and vertically away from the horizontal section, the generally inverted "U" shaped section further curves inwardly extending in an upper rounded arcuate section with an exterior surface, and then the upwardly extending generally inverted "U" shaped section extends downwardly with a second vertical wall with an exterior surface extending in the vertical direction parallel to and spaced apart from the first vertical wall section and then folds back on itself at its lower edge so as to avoid any sharp areas on the rim, the exterior surface of the first vertical wall section, the exterior surface of the second vertical wall section and the exterior section of the upper rounded arcuate section of the generally inverted "U" shaped rim forming a male mating member on the top of the paint can, the interior arcuate shaped rim also surrounding an interior opening which leads to an interior paint can chamber where paint is stored;

b. a top mating closing lid having a first vertical wall with a bottom folding in on itself to avoid sharp edges, the first vertical wall having an interior surface and extending to an upper inwardly extending rounded arcuate section having an interior surface which extends to a downward extending second vertical wall which has an interior surface to form a downwardly extending generally inverted "U" shaped section with the interior surfaces of the first vertical wall, second vertical wall and rounded arcuate wall of the inverted "U" shaped section forming a female receiving member to receive the male member of the "U" shaped male mating member from the top of the paint can, the top closing lid having a circumferential top arcuate section which encircles an interior flat horizontally aligned top to close the opening in the lower portion of the improved lid leading to the chamber in which paint is stored, the top mating closing lid forming a tight seal to the top of the paint can; and c. the horizontal section of the top of the paint can which extends radially inward in the horizontal plane above the top of the paint can prevents paint from falling into an area between the mating male and female "U" shaped members and the upper circumferential rim of the paint can.

* * * * *